United States Patent [19]

Macieowitz

[11] Patent Number: 4,867,215

[45] Date of Patent: Sep. 19, 1989

[54] UTILITY BAG HAVING A RECESSED COMPARTMENT

[76] Inventor: Elisabeth T. Macieowitz, 26 Denning Rd., London NW3 1SU, England, NW3 1SU

[21] Appl. No.: 235,295

[22] Filed: Aug. 23, 1988

Related U.S. Application Data

[63] Continuation-in-part of Ser. No. 91,220, Aug. 31, 1987, abandoned.

[30] Foreign Application Priority Data

Sep. 8, 1986 [GB] United Kingdom ..... 8621561

[51] Int. Cl.[4] ..... A45C 1/08; A45C 3/04; A45C 3/06; A45C 13/00

[52] U.S. Cl. ..... 150/112; 150/101; 150/111; 150/113; 190/101; 190/102; 190/108; 190/109; 190/110; 383/37; 383/38; 383/40

[58] Field of Search ..... 383/2, 4, 37, 38, 39, 383/40, 71, 75; 190/101, 109, 110, 111, 102, 108; 150/101, 102, 103–105, 100, 107, 111, 112, 113, 115–117, 129

[56] References Cited

U.S. PATENT DOCUMENTS

| | | | |
|---|---|---|---|
| 806,888 | 12/1905 | Goldstein | 150/100 |
| 1,056,218 | 3/1913 | Sahl | 383/40 |
| 1,998,798 | 4/1935 | Welch | 150/116 |
| 2,037,175 | 4/1936 | Northcross | 383/71 X |
| 2,447,940 | 8/1948 | Holland | 383/40 X |
| 2,522,604 | 9/1950 | Courter | 383/72 X |
| 2,710,036 | 6/1955 | Marks | 383/38 X |
| 2,731,997 | 1/1956 | Muth et al. | 383/4 |
| 2,799,316 | 7/1957 | Cohen | 150/101 |
| 3,543,825 | 12/1970 | Dobbs | 150/35 |
| 3,870,132 | 3/1975 | Hanley | 190/109 |
| 4,011,898 | 3/1977 | Hubbard | 383/4 X |
| 4,646,804 | 3/1987 | Damiano | 150/112 |

FOREIGN PATENT DOCUMENTS

| | | | |
|---|---|---|---|
| 5615 | of 1899 | United Kingdom | 150/102 |
| 592321 | 9/1947 | United Kingdom . | |
| 649858 | 2/1951 | United Kingdom . | |
| 1505298 | 3/1978 | United Kingdom . | |
| 1571047 | 7/1980 | United Kingdom . | |

*Primary Examiner*—Sue A. Weaver

*Attorney, Agent, or Firm*—Parmelee, Bollinger & Bramblett

[57] ABSTRACT

A carrier bag 1 has within a self-supporting smaller bag 3. The bags 1 and 3 are joined together along their common base 4. The smaller bag 3 has a closeable opening which is readily accessible to a user through the mouth of the carrier bag 1. The smaller bag 3 can be used very simply for accessories, including valuables but with security because it is essentially invisible.

19 Claims, 1 Drawing Sheet

UTILITY BAG HAVING A RECESSED COMPARTMENT

This is a continuation-in-part of co-pending application Ser. No. 091,220 filed on Aug. 31, 1987, now abandoned.

FIELD OF THE INVENTION

This invention relates to utility bags, e.g. sports bags, beach bags, shopping bags and other carrier bags.

The invention is applicable to security devices and to methods of preventing theft of valuable articles from a carrier bag being carried by a user.

BACKGROUND OF THE INVENTION

Utility bags of the type described, adapted to be carried by either hand or shoulder straps, are well known, and may be constructed of a relatively lightweight flexible material, e.g. paper or thin plastics, or of a relatively durable material such as a thicker plastics material, e.g. heavy grade nylon, plastics-coated fabric, leather or canvas material. Such bags will be referred to herein as "carrier bags".

When a pedestrian visits shops or stores for the purpose of purchasing articles, such as articles of food or clothing, a significant difficulty lies in the fact that not only must money and other valuables be conveyed in a conveniently accessible manner but also a receptacle must be carried in which to place the purchased articles. In most cases, this means that two separate bags must be carried: a shopping bag and a handbag. Although it would theoretically be possible to place money and other valuables inside the shopping bag, this is impractical because the valuables would become mixed up with the articles of shopping and thus would not be readily accessible. It would also be possible to place the handbag within the shopping bag but this would defeat the object of carrying the shopping bag since most of the available space would be taken up by the handbag. The need to carry two separate bags is inconvenient because it means that the user's attention must be directed to two separate items and the chances of mislaying or losing one item is correspondingly increased.

Additionally, it is simply more awkward and unwieldy to carry two bags than to carry one.

When a separate handbag is carried, the location of valuables is immediately advertised to any potential bag snatcher or pickpocket. It is well known that money or other valuables are carried in a handbag which has a readily identifiable shape and appearance. Furthermore, owing to the need for easy accessibility, it is common practice for the user of a handbag to leave the fastening undone during shopping thus giving easy access also to a pickpocket. It is also relatively easy for an aggressive thief to simply cut the bag with a knife thus releasing the bag from its handle or releasing the contents.

It is thus clearly apparent that there is a real need for a bag which avoids the above-mentioned difficulties but which does not itself introduce further inconvenient aspects.

PRIOR ART

The combination of bags of different capacities is known. For example, U.S. Pat. No. 3,543,825 discloses a pocketbook including a bellows-type multiple-pocket insert and a relatively narrow coin purse, removably affixed in a cover. GB-A-No. 0649858 and GB-A-No. 1571047 each discloses a carrier bag having a smaller bag fixed at its open mouth; the earlier combination can be folded to form a handbag. GB-A-No. 1505298 discloses a handbag having a number of external pouches. GB-A-No. 0592321 discloses a briefcase, having rigid walls, and a removable pocket inside.

U.S. Pat. No. 1,056,218 to Sahl discloses an open-mouthed outer bag within which is secured a smaller closable bag of flexible material. The Sahl bag is clearly not intended for use as a shopping bag, and is totally unsuitable for this purpose. The smaller bag is intended principally to serve as a cushion for breakable items in a travel bag, and the overall design certainly would not satisfy the requirement of permitting simple access to and opening of the smaller bag while the bag assembly as a whole is being carried by a user, as essential for convenience during shopping.

Bags of this type are not of course normally intended to be carried separately, but would rather be enclosed in and protected by a suitcase.

While it is true that Sahl does not limit to any specific configuration of the inner and outer bags, it is clear from the general nature of the Sahl disclosure that a generally circular or star-like arrangement of pockets around the inside of the larger bag is necessary. It is quite clear that the grouping of the toilet articles in a "star fashion" is an important feature to prevent breakage of the articles contained in the various pockets.

Moreover, the particular arrangement of the fittings is essential to create a "good standing base". In fact, it appears to be imperative that the inner bag should contain a sponge or other soft resilient material in order both to hold the outer breakable articles in position and also to provide the necessary stability to the bag as a whole and to cushion the articles against breakage. This makes it quite clear that the material of the inner bag is not self-supporting, because self-supporting material is insufficiently flexible either to provide a soft cushion itself or to receive resilient properties from a soft resilient sponge contained therein.

U.S. Pat. No. 4,011,898 to Hubbard discloses a combined bag and wallet. The Hubbard wallet-bag is actually a relatively complicated construction. The article disclosed in Hubbard comprises a larger bag located within a smaller bag, the smaller bag being actually visible to others, rather than being concealed. Hubbard cannot have a space between upstanding side walls of the smaller bag and adjacent upstanding side walls of the larger bag. Furthermore, before unfolding and unzipping Hubbard fails to provide an article in which the bags are simultaneously accessible.

The Hubbard bag provides a combined two-sectional vinyl pocket wallet with a foldable soft cloth handbag or shopping and over-the-shoulder bag which is sewn to the vinyl sheet having two half-portions. Each of the two half portions is provided with a zippered pocket opening and a zipper for connecting the two half portions when folded over to house the larger, folded inside cloth bag and to form a wallet small enough to be carried inside a person's pocket.

Before the carrying bag of Hubbard can be used, the wallet must be unzippered by the border zipper and the larger, inside cloth bag unfolded and turned inside-out whereby the vinyl wallet cover becomes the inside bottom, and the base of the larger foldable cloth bag becomes the outside bottom of the carrying bag.

With such an arrangement relatively large items can only be accommodated in the Hubbard device *after* the unfolding and reversing process in which the previously folded, zippered two-sectional pocket wallet is unzippered, extended to its full rectangular size and the larger cloth bag unfolded and turned inside out.

However, when such an unfolding and reversal process is conducted the then extended two-sectioned pocket wallet is level with and parallel to the bottom of the cloth bag and is not upstanding within the larger cloth bag. In fact, in such an arrangement the two zippered pocket openings of the wallet are then substantially inaccessible, hard-to-reach slots, especially when items of shopping are placed in the larger bag and thus are placed on top of these two pocket slots. Moreover, it will be appreciated that even when the larger cloth bag is empty, access to the two pocket slots in the bottom would still be fairly difficult due to the nature and position of the zippered openings.

It is to be further noted that the pockets of Hubbard, because of their construction and placement would not be suitable for holding any breakable articles, such as for example, a pocket mirror, spectacles or glasses, or a comb, when heavy shopping items are to be placed in the cloth bag. The weight of the items pressing on the soft vinyl bottom could cause any such fragile or breakable articles to break or be easily bent or damaged.

Additionally, it will be appreciated that the Hubbard bag is not self-supporting nor can it be. The very nature of the carrying bag of his invention requires a material (nylon or acetate) soft enough to be foldable and thin enough to be accommodated within his pocket sized wallet. Any self-supporting material would be far too bulky for use in his bag. Also, because of its small size, Hubbard's bag could easily be mistaken for a coin purse and could easily be extracted by a thief from a pocket or a handbag. None of the known bags combines ease of use and security. A conventional carrier bag equipped with an inside pocket either secured to or adjacent the mouth of the bag (and which for that reason is often quite noticeable), or incorporated in one of the walls of the bag, is also open to abuse, because the inside pocket is close to the mouth of the carrier bag and is thus too easily accessible to a pick-pocket. Particularly in the case of conventional carrier bags where a small inside pocket is attached by only one of its sides (usually the upper edge) to or near the mouth of the carrier bag and depends downwardly into the interior, the danger exists that the pocket can be ripped off or cut off by a bag-snatcher.

Furthermore, a pocket secured to or adjacent the mouth, or incorporated in a side wall of the carrier bag will, when filled, advertise its existence by allowing the weight of the contents to distort the mouth and pull it downwards towards the interior of the bag or to bulge the side walls as the case may be.

SUMMARY OF THE INVENTION

An object of the invention is to provide a carrier bag enabling carrying of valuable items in a conveniently accessible but nevertheless secure manner.

Another object of the invention is to provide a carrier bag which avoids the need to carry a separate handbag as well as a shopping bag.

A further object of the invention is to provide a security device for enabling transport of valuables in an inconspicuous and hence secure manner.

Another object of the invention is to provide a method of preventing or deterring theft of items from a carrier bag.

A further object of the invention is to provide a bag with a conveniently accessible inner pocket which can be filled without causing bulging or distortion of the bag outer wall.

A yet further object of the invention is to provide a bag for transporting valuables or important documents (according to size) in an inconspicuous and secure, but nevertheless convenient, manner.

According to the present invention, a carrier bag has therewithin a self-supporting closable smaller bag, the two bags being joined together along their respective bases.

In the invention, the smaller bag is contained entirely within the outer bag and the two bags are joined together only along their respective bases. This ensures that the presence of the smaller bag is not apparent from inspection of the outer bag. Furthermore, the smaller bag has a closure means to enable valuables or important documents to be safely enclosed while the outer bag can safely remain with an open mouth. Because the configuration of the outer bag is such that a space is defined on each side of the small bag, not only may articles be placed on either side of the small bag retained by the outer bag, but also the small inner bag may be filled to capacity without causing bulging of the outer bag. Thus, even if the inner bag is tightly packed with articles, its presence is not advertised by exterior bulging or distortion of the outer bag.

In addition, the space between the outer bag and the inner bag provides an additional protection against a thief who slashes the bag with a knife. If he were to cut the outer bag, bearing in mind that the action has to be very quick to be successful, he is unlikely also to damage the inner bag. Even if he did succeed in cutting through both the outer and inner bags, the content of the inner bag is unlikely to fall to the floor, but would probably be partially retained by the outer bag. Furthermore, since the potential thief, even if he is aware of the presence of the inner bag, does not know precisely its size or location, he would need to be very fortunate to cut the outer bag at precisely the correct point.

By forming both bags of self-supporting or semi-rigid material, according to the invention one-handed access to the smaller bag is readily possible because the smaller bag stands upright within the outer bag. Because the smaller bag is secured along the length of its base to the outer bag, sufficient stability is ensured to permit opening of the smaller bag, again in a one-handed fashion, while the outer bag is carried by the user. This avoids the need for the bag to be placed on the ground or another firm surface to enable access to the smaller inner bag.

In summary, the carrier bag according to the invention is convenient because it is holdable with one arm while being accessible with the other, and the inner bag is self-supporting and fixed so that it is easy to find by touch and avoids the need for a separate handbag, thus giving the user a free arm. Furthermore, the self-supporting nature of the material and the mode of joining together the two bags permit the user to unfasten the inner bag with one hand, yet maintaining relative inaccessibility for the pickpocket.

The bag according to the invention is secure because the inner bag is invisible to others by being well hidden within the outer bag thus ensuring protection and security. While being carried, not only would it be difficult for a pickpocket to reach, but it would be difficult or impossible for a thief quickly to cut or otherwise remove the inner bag. Because the bag according to the invention will resemble an ordinary shopping bag, the thief is unlikely to suspect that the contents may be more valuable. Owing to the configuration providing space between the inner and outer bags, the inner bag can be filled without causing distortion or bulging of the outer bag. The space also allows filling of the outer bag about the inner bag and protects additionally against a thief attempting to cut the wall of the bag with a knife. In addition, if desired, the small bag may be folded flat if its use is not required.

In embodiments in which the inner bag is less than half the height of the outer bag, security is further enhanced because it becomes even more difficult for a thief to see or reach the inner bag.

Any unauthorised removal of any of the contents inside the smaller bag is greatly impeded, whether or not the user is paying particular attention to the load and whether or not the carrier bag contains goods. The smaller bag is usually undetectable by a potential bag-snatcher. There is nothing on the outside (no seams, studs, clips etc) indicating that the carrier bag serves any purpose other than the carrying of goods and that it, in fact, conceals therewithin another bag which functions as a substitute handbag and may contain valuables. Even if the smaller bag contains valuables and is noticed by a bag-snatcher, it cannot be removed without difficulty and without the awareness of the user.

According to one aspect of the invention, there is provided a carrier bag assembly for use as an anti-theft device comprising an outer bag having a base, upstanding side-walls, upstanding side ends and a mouth, suitable to be held by the hand or carried over the shoulder of a user, and which additionally comprises within the outer bag a smaller bag having a base, the two bags being joined together along their respective bases, and in which the smaller bag has upstanding sides terminated by side edges and a closable opening which is readily accessible to the user through the open mouth of the outer bag, the smaller bag having closure means for releasably closing said closable opening, the configuration of the base of the outer beg being such that a space is defined on each side of the smaller bag, between each said upstanding side of the smaller bag and a respective adjacent upstanding side-wall of the outer bag, and both bags being of material sufficiently self-supporting to permit one-handed access to and opening of the smaller bag while the carrier bag assembly is being carried by the user.

According to another aspect of the invention, there is provided an anti-theft device comprising: an outer bag having a base, upstanding side-walls, side ends and a mouth; and a smaller bag for containing valuables and positioned on and centrally of the base of the outer bag, the smaller bag standing upright within the outer bag and having a base and upstanding sides, the outer and smaller bags being joined together along their respective bases, and the base of the outer bag being dimensioned to provide a space on each side of the smaller bag between each upstanding side of the smaller bag and the respective adjacent upstanding side-wall of the outer bag, whereby the smaller bag is well protected by and concealed within the outer bag and the device permits safe transport of valuables in an inconspicuous manner.

According to a further aspect of the invention, there is provided a method of preventing theft of valuable articles from a carrier bag carried by a user, the method comprising the steps of:

providing an outer bag having a base, upstanding side-walls, side ends and a mouth;

providing a smaller bag having a base and upstanding side walls;

positioning the smaller bag within the outer bag and centrally of the base thereof;

joining the outer and smaller bags together along their respective bases in a manner to provide a space on each side of the smaller bag between each upstanding side of the smaller bag and the respective adjacent upstanding side-wall of the outer bag;

placing valuables within the smaller bag; and transporting the combination of the outer and smaller bags.

A prior attempt to solve the security problem discussed above is represented by Cohen (U.S. Pat. No. 2,799,316). However, the solution offered by Cohen is totally different and has significant disadvantages as against the solution of the present invention. Far from attempting to conceal the presence of the inner bag, Cohen advertises its presence by positioning it visibly in the top of the outer bag as shown in each of the two embodiments of FIGS. 1 and 4. Furthermore, when the inner bag is in position the outer bag is unusable without removing the inner bag. Thus, in spite of Cohen's attempts to solve exactly the same problem, the solution reached is quite different and markedly inferior to that of the present invention.

BRIEF DESCRIPTION OF THE DRAWINGS

In the accompanying drawings, which are given by way of example only.

DETAILED DESCRIPTION OF THE INVENTION

Figure 1:
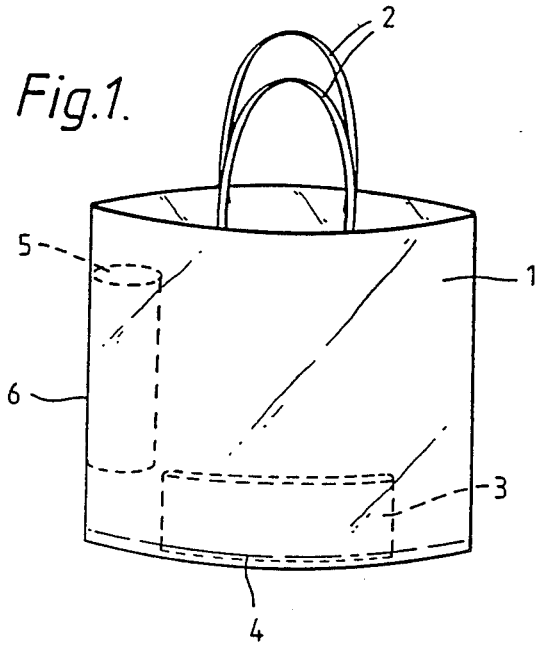
FIG. 1 is a perspective view of one carrier bag assembly embodying the invention, and showing the smaller bag and also an open-ended sleeve in outline.

FIG. 1 shows a carrier bag 1 having handles 2. A smaller bag 3 and an open-ended sleeve 5 are shown in outline (dashed lines). The two bags 1,3 are joined together along their common base 4. The carrier bag 1 and the sleeve 5 are joined together along their common side 6.

As will be noted, the overall configuration of the bag 1 is generally rectangular. That is to say, the base 4 is substantially perpendicular both to edge 6 and also to the oppositely lying parallel edge. Similarly, the open mouth of the bag 1 defines a surface substantially parallel to the base 4. As will be noted, the smaller bag 3 is positioned substantially centrally between the side edges 6, so that a space is defined between each side edge 6 and the closer end of the smaller bag 3. This not only is conducive to good weight distribution, but also the gap provides additional security against a thief cutting the outer bag with a knife. This aspect will be discussed in more detail hereinafter.

Figure 2:
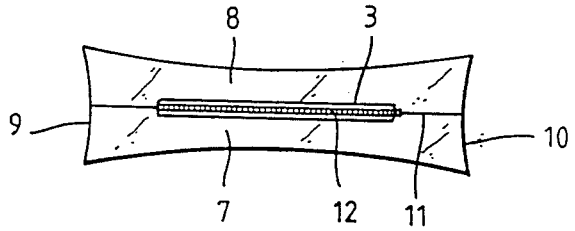
FIG. 2 is a plan view of the base of another preferred embodiment of the invention.

FIG. 2 shows the base of a preferred carrier bag of the invention, which has a configuration such that spaces 7,8 are defined between the sides of the smaller bag 3 and the respective adjacent side-walls (not shown in FIG. 2) of the carrier bag. The configuration is defined by seams 9,10,11. The smaller bag 3, having a zip-fastening closure 12, is sewn along its base within the seam 11.

As will be seen from inspection of FIG. 2, in plan view the bag is substantially rectangular, and has side edges 9 and 10 substantially perpendicular to the major faces constituting the side walls of the outer bag. It will be seen that the smaller inner bag is positioned substantially centrally within the base of the outer bag. In FIG. 2, the base is generally rectangular, the side edges 9 and 10 being formed by cross-stitching. Preferably, the cross-stitching is arranged to ensure that the width of the base is between ⅓ and 1/6 the length of the base, preferably about ¼ of the length.

Preferably, the smaller bag 3 is secured into the seam 11 of the outer bag by a single row of stitching, and the seam 11 is then further secured by a second row of stitching. Preferably, the second row of stitching is positioned to ensure that the inserted bottom edge of the smaller bag 3 is invisible from inspection of the outer bag.

The second row of stiching gives additional reinforcement and strength to the bottom of the bag.

The carrier bag assembly is, for example, 250 to 600 mm long and 250 to 600 mm high (excluding handles). It may have negligible width (side-wall-to-side-wall, when empty) or, as illustrated in FIG. 2, a base which defines a certain side-to-side width, e.g. 50 to 200 mm. The smaller bag may be, for example, 80 to 320 mm high, but preferably is less than half the height of the carrier bag; its length may be the same as or, as illustrated, less than that of the carrier bag. In the latter case, and as shown, there are spaces between the respective side ends of the bags in addition to the spaces 7,8.

The smaller bag and preferably also the carrier bag are of a self-supporting material, such as a plastics-coated fabric, cotton-backed PVC, canvass or leather.

The use of a self-supporting material is required not only to give the bag assembly a certain durability, but also to ensure that the inner bag 3 stands upright within the outer bag and is thus readily accessible to the user, in a one-handed fashion, simply by inserting the hand through the open mouth of the outer bag. Since the inner bag 3 is fixed within the outer bag, its position is defined, and because it stands upright it is easily located and opened. If necessary, it is easy to locate the inner bag 3 by touch alone and this facilitates use of the bag assembly by blind persons or persons of restricted vision. In spite of the fact that the inner bag is readily accessible to the user, it is not easy for a bag snatcher or pick-pocket to gain access to the inner bag without detection by the user. Of course, in view of the fact that the inner bag is concealed within the outer bag, it is in most cases unlikely that a bag snatcher or thief would realise that the smaller bag existed.

The two bags may be adapted to be detachable, e.g. by being zipped or clipped together. Alternatively, and as will often be preferred, the bags are sewn together or otherwise secured along their respective bases.

The smaller bag may be closable along its top by a zip (as illustrated) or any other suitable type of closure such as a flap and corresponding closure members or devices affixed to the flap and the outside of one wall of the smaller bag, respectively. A zip could conveniently be associated with a lock, if desired, in order to maximise the problems for a potential pick-pocket.

If desired, the holding function of the smaller bag can be ignored. When empty, it can by choice easily be flattened against the base and/or a side-wall of the carrier bag.

The carrier bag may have therewithin an open-ended sleeve (see sleeve 5 in the drawings) of a self-supporting material, the sleeve being joined along a side thereof to one of the sides of the carrier bag on the same principle as the small accessories bag, i.e. being zipped/clipped or sewn together.

Such a sleeve has various purposes. Firstly, it provides support for cumbersome long items of shopping or objects for personal use, e.g. an umbrella, in order to keep them in place and to prevent them from distorting the shape of the carrier bag. Secondly, it allows in particular persons accompanied by small children instant access to a baby bottle containing milk or fruit juice, without having to search for it among their other carried belongings. Thirdly, it provides easy access to, say, an umbrella or rolled-up magazine/newspaper without upsetting the contents of the carrier bag.

When the sleeve is not in use, it can be flattened against the side of the carrier bag, with no effect on the "carrying" volume available to the user. In addition, blind persons or those of limited vision, may easily locate articles positioned in the sleeve.

The bag according to the invention can in some embodiments be used by the general public principally as a shopping bag. For such use, it will be manufactured in sizes which are manageable for the average user and which permit the inner smaller bag to be easily accessible with one hand while the bag combination is being carried.

The smaller bag may serve as a substitute handbag but with added protection and security for items of value. However, it should be noted that the size of the smaller bag is variable, i.e. it can be substantially increased in a bag assembly of far larger than average shopping size. Bag assemblies of the larger type are particularly suitable for transporting in a most effective inconspicuous way important documents, money, jewellery, precious stones, etc., particularly in such cases where transport by a person on foot through a crowded environment is necessary and unavoidable and where it is of utmost importance that no attention whatever is drawn to the items in transport.

Furthermore, within the scope of the invention the inner bag may be provided with a removable insulation lining, whereby the smaller bag is converted into a temporary portable storage compartment for frozen foods.

Whatever the sizes of the outer bag and the inner bag, protection and security are at all times inconspicuously provided for items of value whether a user carries shopping, sports or beach gear, etc. In such cases where highly valuable objects need to be transported under cover, the outside appearance of the bag assembly provides an ideal camouflage for the precious contents inside the smaller bag and thus augments the existing security.

I claim:

1. A carrier bag assembly for use as an anti-theft device comprising an outer bag having a base, upstanding side-walls, upstanding side ends and a mouth, including means suitable to be held by the hand or carrier over the shoulder of a user, and which additionally comprises within the outer bag a smaller bag having a base, the two bags being joined together along their respective bases, and in which the smaller bag has upstanding sides terminated by side edges and a closable opening which is radially accessible to the user through the open mouth of the outer bag, the smaller bag having closure means for releasably closing said closable opening, the configuration of the base of the outer bag being such that a space is defined on each side of the smaller bag, between each said upstanding side of the smaller bag and a respective adjacent upstanding side-wall of the outer bag, and both bags being of material sufficiently self-supporting to permit one-handed access to and opening of the smaller bag while the carrier bag assembly is being carried by the user.

2. A carrier bag assembly according to claim 1, in which the smaller bag is less than half the height of the outer bag.

3. A carrier bag assembly according to claim 1 wherein a gap is defined between each upstanding side end of said outer bag and the closer of said side edges of said smaller bag.

4. A carrier bag assembly according to claim 1 wherein the inner bag and the outer bag are joined only along their respective bases.

5. A carrier bag assembly according to claim 1 wherein said outer bag has a seam extending along the base thereof.

6. A carrier bag assembly according to claim 5 wherein said smaller bag is joined to said outer bag by being secured within said seam.

7. A carrier bag assembly according to claim 1 wherein said outer bag additionally includes therewithin an open-ended sleeve, said sleeve being joined along a side thereof to one of the side ends of the outer bag.

8. A carrier bag assembly according to claim 2 wherein said outer bag additionally includes therewithin an open-ended sleeve, said sleeve being joined along a side thereof to one of the side ends of the outer bag.

9. A carrier bag assembly according to claim 1 wherein the outer bag and smaller bag include means for detachably joining said bags at their respective bases.

10. A carrier bag assembly according to claim 9 wherein said outer bag additionally includes therewithin an open-ended sleeve, said sleeve being joined along a side thereof to one of the side ends of the outer bag.

11. A carrier bag according to claim 1 wherein the base of the outer bag is generally rectangular.

12. A carrier bag according to claim 11 wherein the width of the base of the outer bag is between one-third and one-sixth of the length of the outer bag.

13. A carrier bag assembly for use as an anti-theft device comprising an outer bag having a base, upstanding side-walls, side ends and a mouth, including means suitable to be held by hand or carried over the shoulder of a user, and which additionally comprises within the outer bag a smaller bag which stands upright therewithin, and having a base and upstanding sides, the upstanding sides of the smaller bag less than half the height of the upstanding side-wall of said outer bag, said outer bag and said smaller bag being joined together along their respective bases in a configuration at the base of said outer bag such that a space is defined on each side of the smaller bag between each upstanding side of the smaller bag and a respective adjacent upstanding side-wall of the outer bag, and in which said smaller bag has a closable opening which is readily accessible to the user through the open mouth of said outer bag while said smaller bag remains essentially invisible to the others, the smaller bag having closure means for releasably closing said closable opening and both bags being of material sufficiently self-supporting to permit one-handed access to and opening of the smaller bag while the carrier bag assembly is being carried by the user.

14. A carrier bag assembly according to claim 13 wherein the outer bag and smaller bag include means for detachably joining said bags at their respective bases.

15. A carrier bag assembly according to claim 13 wherein said outer bag additionally includes therewithin an open-ended sleeve, said sleeve being joined along a side thereof to one of the side ends of the outer bag.

16. A carrier bag assembly according to claim 14 wherein said outer bag additionally includes therewithin an open-ended sleeve, said sleeve being joined along a side thereof to one of the side ends of the outer bag.

17. A carrier bag according to claim 13 wherein the base of the outer bag is generally rectangular.

18. A carrier bag according to claim 17 wherein the width of the base of the outer bag is between one-third and one-sixth of the length of the outer bag.

19. An anti-theft device comprising:

an outer bag having a base, upstanding side-walls, side ends and a mouth; and a smaller bag for containing valuables and positioned on and centrally of the base of the outer bag, the smaller bag standing upright within the outer bag and having a base and upstanding sides, the outer and smaller bags being joined together along their respective bases, and the base of the outer bag being dimensioned to provide a space on each side of the smaller bag between each upstanding side of the smaller bag and the respective adjacent upstanding side-wall of the outer bag, whereby the smaller bag is well protected by and concealed within the outer bag and the device permits safe transport of said valuables in an inconspicuous manner.

* * * * *